United States Patent [19]

Scott et al.

[11] 4,307,149

[45] Dec. 22, 1981

[54] TRANSFER ELEMENTS AND PROCESS FOR MAKING SAME

[75] Inventors: Michael A. Scott, Huntington; Cathy D. de Fanis, Bethpage, both of N.Y.

[73] Assignee: Columbia Ribbon & Carbon Mfg. Co., Inc., Plainview, N.Y.

[21] Appl. No.: 91,642

[22] Filed: Nov. 5, 1979

[51] Int. Cl.[3] ..... B41M 5/02

[52] U.S. Cl. ..... 428/323; 427/54.1; 427/146; 427/160; 427/162; 427/404; 428/207; 428/208; 428/328; 428/336; 428/339; 428/484; 428/488; 428/913; 428/914

[58] Field of Search ..... 8/7; 106/23, 31; 260/37 NP, 37 P, 42.21; 427/54.1, 146, 152, 160, 162, 404; 428/307, 484, 488, 913, 914, 207, 208, 323, 328, 336, 339

[56] References Cited

U.S. PATENT DOCUMENTS

| | | | |
|---|---|---|---|
| 2,729,575 | 1/1956 | Newman | 117/36 |
| 2,822,288 | 2/1958 | Harvey et al. | 428/488 |
| 3,036,924 | 5/1962 | Newman | 106/31 |
| 3,446,646 | 5/1969 | Terry | 428/488 |
| 3,449,149 | 6/1969 | Toussaint | 428/488 |
| 3,930,063 | 12/1975 | Miller et al. | 106/23 |
| 4,010,293 | 3/1977 | Davis | 106/23 |

*Primary Examiner*—Bruce H. Hess
*Attorney, Agent, or Firm*—Thomas L. Tully

[57] ABSTRACT

Pressure-sensitive transfer elements having a plastic film foundation carrying a frangible, opaque, pressure-transfer layer applied by means of a volatile coating vehicle and comprising a solid solution of a fluorescing dye in a resinous binder material, said layer also containing a minor amount by weight of an opaque lamelliform pigment such as a bronze powder. Such transfer elements are adapted to transfer solid images to the surface of a copy sheet, which images fluoresce to provide a relatively uniform or level signal under exposure to ultraviolet light regardless of whether said images are present on differently-colored areas of the copy sheet surface.

15 Claims, No Drawings

TRANSFER ELEMENTS AND PROCESS FOR MAKING SAME

BACKGROUND OF THE INVENTION

The use of fluorescent liquid inks is well-known for the application of information to various types of documents which are intended to be exposed to ultraviolet radiation and then processed or read by means of detection machines. Such inks are widely used for the application of data information to checks for the indication of amounts, dates, banks involved, etc., enabling the checks to be sorted and routed automatically by processing machines.

The conventional fluorescent inks are liquid inks which are applied to the intended documents by means of fabric printing ribbons or ink pads. In many cases, different images and data are applied to the same document using different inks to provide information which is automatically sensible by optical, magnetic or other sensing devices. In such cases the fluorescing images frequently are applied over said other images such as over black optical or magnetic images.

Different fluorescing dyes have different colors and emit different wave-length radiation when exposed to and excited by ultraviolet radiation. The processing machines are quite sensitive and can be adjusted to detect and recognize either strong or weak signals within the emitted wavelength range. This adjustment requirement is necessitated by the fact that some detectible images are relatively poor in mass and/or quality or are absorbed and broadened when applied as liquid inks to porous copy papers so as to provide relatively weak signals while other detectible images are of good mass and quality and emit strong signals. The processing machine can be adjusted to read strong or weak signals but cannot reliably read both strong and weak signals emitted by images present on the same document. If the images cannot be read by the processing machine, the document is rejected and must be processed manually. In some cases, the imperfect images will be misread by the processing machine, causing errors. These defects frustrate the entire purpose of the system.

One of the most common causes of defective results in the system arises from the fact that the fluorescent inks frequently are typed or printed in overlapping relation over pre-applied images of contrasting color, i.e., over black images or bar codes comprising magnetic or optical inks. The fluorescing images, or portions thereof, applied directly to the light-colored paper stock emit strong signals under irradiation while the fluorescing images, or portions thereof, applied over the black images or bar codes, provide substantially weaker signals under irradiation. The sensitivity of the processing machine can be adjusted for the accurate recognition of the weak signals but such adjustment results in a loss of reliability with respect to the sensing of the strong signals, and vice-versa.

SUMMARY OF THE INVENTION

The present invention relates to novel pressure-sensitive transfer elements having a plastic film foundation supporting a frangible, complete-release transfer layer of a solid, non-penetrating, volatile-vehicle-applied composition comprising a synthetic thermoplastic resinous binder material containing at least one dissolved fluorescing dyestuff and a small amount of a finely divided lamelliform pigment such as a bronze powder.

The present transfer elements provide solid, pressure-transferable compositions which have good affinity for copy sheets and do not penetrate substantially within even porous paper copy sheets when transferred thereto under the effects of imaging pressure. The present compositions contain fluorescing dyes in the form of solid solutions, in which form the dyes have the greatest ability to emit strong radiation under exposure to ultraviolet radiation. The present compositions also contain opaque lamelliform particles in amounts which do not unduly mask the radiation emitted by the excited dyestuffs but which do provide a selective barrier between the dye images and the background on which they are supported so that such background has a substantially reduced effect upon the strength of the signals emitted by the dye images under irradiation, thereby providing more uniform signals regardless of background.

Since the images produced by the present transfer elements should be as sharp and dense as possible, the transfer elements have a smooth inert film foundation such as polyethylene, polypropylene, polyethylene terephthalate or other thin film which has the ability to sharply and completely release the transfer composition in a stencilling manner under the effects of imaging pressure such as typing or printing pressure.

The preferred compositions of the present invention are applied to the film foundation as liquid coating compositions comprising a major amount by weight of a volatile solvent such as methyl ethyl ketone, ethyl acetate, toluene and/or other solvents depending upon the specific other ingredients of the composition, a film-forming resinous binder material which is soluble in said solvent and which is a solvent for the particular fluorescing dyes used therewith, one or more fluorescing dyes which are soluble in both said solvent and in said resinous binder material, a wax which is mainly insoluble but preferably partially soluble to a minor extent in said solvent so as to provide, on drying and solidification of said composition, substantially discontinuous wax particles preferably associated with a continuous wax phase, a non-volatile oil plasticizer for said wax which is compatible with said wax and is a solvent for said dye so as to form a solid solution of said dye in said wax, and a minor amount by weight of a finely divided lamelliform pigment, preferably a bronze powder.

Suitable film-forming binder materials will vary to some extent depending upon the specific fluorescing dyes used therewith. However, the generally suitable resin binder materials include vinyl chloride-vinyl acetate copolymers such as Vinylite VYHH, acrylic polymers such as Elvacite (copolymer of methyl methacrylate and ethyl acrylate), linear polyesters such as Vitel (terephthalic acid-aliphatic acid copolyester), and similar resins which are solvents for the dyes, soluble in the coating solvent and which do not mask or unduly impede the fluorescence of the dyes.

Preferred waxes for use in the present compositions are the hard waxes which can be pulverized to the form of fine particulate powders which can readily be mixed with the plasticizer and melted to form the plasticized wax. The required adhesion of the coating to the film foundation and the required stencilling or complete transfer properties of the coating are improved in cases where the wax is present in both dissolved and dispersed form. Preferably, the wax is present in at least about 80% by weight particulate form and at least 20% by weight continuous form in the final transfer layer but these percentages are difficult to establish since it appears that some of the dissolved wax precipitates during drying of the coated composition. A preferred wax is carnauba wax but other waxes such as ouricury wax, microcrystalline wax, candelilla wax, montan wax and the like can also be used with the proper selection of coating solvent and compatible softener or plasticizer. Soft waxes such as beeswax, petroleum wax and the like are unsuitable.

The selection of the appropriate softener or plasticizer oil will depend upon the particular wax used. In all cases, the plasticizer must be non-volatile, compatible with the wax and a solvent for the fluorescing dye. A preferred plasticizer for use with carnauba wax is a sorbitan ester such as sorbitan monolaurate. In general, the petroleum oils are unsatisfactory since they are not solvents for the conventional fluorescing pigments. Esters, such as butyl stearate and dioctyl phthalate, vegetable oils, animal oils and related non-volatile oily materials, may be selected depending upon their solvent properties for the dye and their compatibility with the wax.

The fluorescing dyes useful according to the present invention are those which are capable of emitting intense radiation within the range of from about 300 mμ to about 700 mμ when exposed to a light source rich in ultraviolet radiation. Suitable dyes include the flavins and thioflavins which have a bright yellow color and emit a high signal in the area of about 600 mμ and Rhodamine B which has a reddish color and emits a signal in the area of between 400 mμ and 500 mμ. Preferably, a combination of the yellow and red dyes is used in order to obtain the strong signal of the yellow dye and the coloration of the red dye which makes the formed images more easily readable by the naked eye.

The preferred lamelliform pigments for use according to the present invention are the so-called bronze powders which include fine powders of metals such as aluminum, copper, zinc, manganese, and others. Such materials provide a selective masking property whereby they substantially increase the hiding power of the transfer composition while not unduly masking the fluorescing dyes from the applied radiation or preventing the image signals from being sensed. The end result is that the present compositions emit a weaker signal than corresponding compositions which do not contain any lamelliform pigment, but the present compositions emit a more uniform or level signal whether applied over a light or a dark background so that they can be sensed more accurately than similar compositions which do not contain any lamelliform pigment.

The amount of included lamelliform pigment may be varied between about 0.25% and 5% by weight, based upon the solids content of the transfer composition. Amounts at the lower end of the range have a smaller blocking effect upon the strength of the signal emitted by the irradiated composition but also have a smaller masking effect upon the background on which the images are supported. Amounts at the upper end of the range provide better masking of the background and more uniform signal strength but the signal strength is uniformly diminished to a greater degree. However, as mentioned supra, the processing or sensing equipment can be adjusted to reliably read images of uniform low or weak signal strength. The most preferred range of bronze powder content is from about 0.8% to 1.5% of the total solids content.

The present lamelliform pigments have the ability to float towards the surface of the present fluid solvent coating compositions during the application of such compositions to the film foundation and to be isolated as a surface stratum when the coating solvent is evaporated to solidify the transfer layer. Thus, when the transfer layer is pressure-transferred to a copy sheet, the lamelliform stratum forms a barrier layer adjacent the surface of the copy sheet and the fluorescing dye composition is mainly above said barrier stratum and not masked thereby to an unacceptable degree. Moreover, the concentration of the lamelliform pigment in a barrier stratum renders said pigment more effective in masking the underlying color of the copy sheet and reducing the effect of contrasting underlying colors upon the intensity of the signal generated by the irradiated images. Another advantage of such barrier layer, adjacent the copy sheet surface, is that such a layer substantially reduces the possibility of images, produced by means of the present transfer elements, being sensed through the copy sheet. This is important in the case of copy sheets which carry fluorescing images on both the front and rear surfaces thereof, which images comprise different bits of information which are sensed at different times. Images sensible through the copy sheet can cause the sensing device to misread or reject the imaged copy sheet, thereby frustrating the system.

Such migration and concentration of the lamelliform pigment depends upon the fluidity of the applied coating composition and the period of time during which the coating remains fluid before the volatile solvent is evaporated.

The selection of suitable coating solvents will depend upon the particular ingredients present in the composition and such selection will be obvious to one skilled in the art. Generally, the solids content of the coating composition will be within the range of from about 13% to about 20%, most preferably between 15% and 18%. Thus the volatile solvent content will range between about 80% and 87%.

While the proportions of the ingredients of the preferred compositions may be varied somewhat, depending upon the specific material used, the following table is illustrative of such proportions:

| Ingredient | % by Weight (solids) | % by Weight (total) |
|---|---|---|
| Resin binder | 20 to 30 | 2.6 to 6 |
| Hard wax | 20 to 30 | 2.6 to 6 |
| Plasticizer | 30 to 45 | 4.3 to 9 |
| Dye(s) | 3 to 30 | 0.5 to 5 |
| Bronze Powder(s) | 0.25 to 5 | 0.065 to 1 |
| Solvent(s) | — | 80 to 87 |

The following example illustrates the preparation of transfer elements according to one embodiment of the present invention:

EXAMPLE

| Ingredient | Parts by Weight |
|---|---|
| Vinyl chloride-vinyl acetate copolymer | 4.0 |
| Carnauba wax | 4.0 |
| Sorbitan monolaurate | 6.0 |
| Flavine dye | 1.0 |
| Rhodamine B dye | 1.0 |
| Bronze Powder | 0.2 |

-continued

| Ingredient | Parts by Weight |
|---|---|
| Methyl ethyl ketone | 84.0 |

The vinyl resin is dissolved in the methyl ethyl ketone and a hot melt of the wax and plasticizer is slowly added thereto with stirring to cause a portion of the plasticized wax to be dissolved by the solvent. Thereafter, the dyes are added and dissolved, the bronze powder is added and the composition is mixed in a ball mill for several hours.

The solvent composition is coated as a thin layer over the film foundation and the solvent is evaporated to solidify the imaging layer having a thickness of from about 0.0002 inch to 0.001 inch.

Finally, the coated web is cut into sheet lengths and widths or ribbon lengths and widths depending upon the desired end use.

Variations and modifications will be apparent to those skilled in the art within the scope of the appended claims.

We claim:

1. A pressure-sensitive transfer element adapted to transfer solid, fluorescing images to a copy sheet under the effect of imaging pressure, comprising a smooth, thin plastic film foundation supporting a volatile solvent-applied, complete-transfer imaging layer comprising a synthetic thermoplastic resin binder material which is soluble in the application solvent, from about 0.25% to about 5.0% by weight, based upon the solids content, of a fluorescing dye in the form of a solid solution within said imaging layer and capable of emitting intense radiation within the range of from about 300 mμ to about 700 mμ when exposed to a light source rich in ultraviolet radiation, and a minor amount by weight of an opaque lamelliform pigment which is present mainly in a surface stratum of said imaging layer and is adapted to mask the color of the surface of said copy sheet to which said images are transferred without preventing said images from fluorescing under the effects of applied radiation.

2. A transfer element according to claim 1 in which the resin binder material comprises a vinyl chloride-vinyl acetate copolymer.

3. A transfer element according to claim 1 in which the imaging layer also comprises a hard wax which is at least partially insoluble in the application solvent.

4. A transfer element according to claim 3 in which the imaging layer also comprises a non-volatile oily liquid plasticizer which is compatible with said hard wax.

5. A transfer element according to any one of claims 1, 2, 3 or 4 in which said lamelliform pigment comprises a bronze powder.

6. A transfer element according to claim 1 in which the fluorescing dye comprises a mixture of at least two such dyes having different colors and emitting radiation of different wave lengths within the range of from about 300 mμ to about 700 mμ when exposed to a light source rich in ultraviolet radiation.

7. A pressure-sensitive transfer element according to claim 1 in which the imaging layer comprises 20 to 30% by weight of the resin binder material, 3 to 30% by weight of the fluorescing dye and from 0.25 to 5% by weight of the lamelliform pigment.

8. A pressure-sensitive transfer element according to claims 4 or 7 in which the imaging layer comprises 20 to 30% by weight of the hard wax and 30 to 45% by weight of the oily liquid plasticizer.

9. A method for producing a pressure-sensitive transfer element adapted to transfer solid fluorescing images to a copy sheet under the effect of imaging pressure comprising the steps of:

(a) preparing a coating composition by dissolving a synthetic thermoplastic resinous binder material and a fluorescing dye in a volatile organic solvent, said dye being capable of emitting intense radiation within the range of from about 300 mμ to about 700 mμ when exposed to a light source rich in ultraviolet radiation, and mixing therewith from about 0.25% to about 5.0% by weight, based upon the solids content of a lamelliform pigment;

(b) applying said coating composition as a uniform thin layer to a smooth plastic film foundation, and (c) evaporating said volatile organic solvent to form a solid, complete-transfer imaging layer containing said fluorescing dye in the form of a solid solution and containing said lamelliform pigment mainly in a surface stratum as a masking agent which at least partially masks the color of the surface of the copy sheet to which said composition is transferred in image form without preventing the dye in said images from fluorescing under the effects of applied radiation.

10. A method according to claim 9 which comprises including in the coating composition of step (a) a hard wax which is at least partially soluble in said volatile organic solvent, and a non-volatile oily liquid which is compatible with and is a plasticizer for said hard wax.

11. A method according to claim 9 or 10 in which said lamelliform pigment comprises a bronze powder.

12. A method according to claim 10 in which said coating composition comprises vinyl chloride-vinyl acetate resin binder material, carnauba wax, a sorbitan ester plasticizer, fluorescing dye and bronze powder.

13. A method according to claim 9 in which said coating composition has a solids content within the range of from about 13% to about 20%.

14. A method according to claim 9 in which said coating composition is applied in amounts sufficient to form a solid transfer layer having a thickness between about 0.0002 inch and 0.001 inch.

15. A method according to any one of claims 9, 10, 13 or 14 in which said applied coating composition is maintained fluid for a sufficient time to permit a substantial portion of said lamelliform pigment to float towards the surface of the applied coating to form a surface stratum of concentrated lamelliform pigment adjacent said surface prior to the evaporation of the volatile organic solvent.

* * * * *

UNITED STATES PATENT AND TRADEMARK OFFICE

CERTIFICATE OF CORRECTION

PATENT NO. : 4,307,149

DATED : December 22, 1981

INVENTOR(S) : M. A. Scott et al

It is certified that error appears in the above-identified patent and that said Letters Patent are hereby corrected as shown below:

In column 5, line 33, 0.25% to about 5.0% should appear 3% to about 30%.

Signed and Sealed this

*Twentieth* Day of *September 1983*

[SEAL]

*Attest:*

GERALD J. MOSSINGHOFF

*Attesting Officer*

*Commissioner of Patents and Trademarks*